US007332697B2

(12) United States Patent
Vatsya

(10) Patent No.: US 7,332,697 B2
(45) Date of Patent: Feb. 19, 2008

(54) PHOTONIC BANDGAP REFLECTOR-SUPPRESSOR

(75) Inventor: S. Raj Vatsya, London (CA)

(73) Assignee: National Research Council of Canada, Ottawa, Ontario ( * ) Notice: Subject to any disclaimer, the term of this patent is extended or adjusted under 35 U.S.C. 154(b) by 107 days.

(21) Appl. No.: 11/315,007

(22) Filed: Dec. 23, 2005

(65) Prior Publication Data

US 2007/0145046 A1 Jun. 28, 2007

(51) Int. Cl.
*H05B 6/74* (2006.01)

(52) U.S. Cl. ..... 219/745; 219/750

(58) Field of Classification Search ..... 219/745, 219/746, 747, 748, 749, 756, 750, 728; *H05B 6/74*
See application file for complete search history.

(56) References Cited

U.S. PATENT DOCUMENTS

| | | | | |
|---|---|---|---|---|
| 5,440,421 | A * | 8/1995 | Fan et al. | 359/245 |
| 5,600,483 | A * | 2/1997 | Fan et al. | 359/245 |
| 5,999,308 | A * | 12/1999 | Nelson et al. | 359/321 |
| 6,130,780 | A | 10/2000 | Joannopoulos et al. | |
| 6,583,350 | B1 * | 6/2003 | Gee et al. | 136/253 |
| 6,941,055 | B2 | 9/2005 | Segawa et al. | |
| 2001/0012149 | A1 * | 8/2001 | Lin et al. | 359/344 |

FOREIGN PATENT DOCUMENTS

| | | |
|---|---|---|
| WO | WO 01/84663 | 8/2001 |

OTHER PUBLICATIONS

R. Courant and D. Hilbert, "Methods of Mathematical Physics", vol. 1, Interscience Publishers, Inc., New York, 1953, pp. 102-107.
Joannopoulos, J., et al., "Photonic Crystals: Molding the Flow of Light", Appendix D, Princeton University Press, pp. 56-57.
Joannopoulos, J., et al., "Photonic Crystals: Molding the Flow of Light", Chapter Five, Princeton University Press, pp. 127-129.
Tai, C.C. et al., "Related Upper and Lower Bounds to Atomic Binding Energies", International Journal of Quantum Chemistry, vol. 46, 675-688 (1993).

* cited by examiner

*Primary Examiner*—Daniel Robinson
(74) *Attorney, Agent, or Firm*—Hans Koenig

(57) ABSTRACT

A computer-based design methodology for photonic bandgap devices that permits determination of both the upper and lower bandgap edges in either a one-dimensional or two-dimensional photonic crystal. Using this methodology, a one-dimensional crystal may be created for use in a waveguide-fed microwave oven as a radiation reflector-suppressor, particularly for undesirable higher harmonic frequencies of about 12 GHz. By conceptually arranging multiple reflectors in a desired geometry, a two-dimensional crystal may be created that is particularly useful as a waveguide or splitter. The waveguide or splitter thus created has especially high efficiency for microwave wavelength ranges of about 9 GHz as compared with the prior art and is particularly useful in communications applications.

14 Claims, 13 Drawing Sheets

PHOTONIC BANDGAP REFLECTOR-SUPPRESSOR

FIELD OF THE INVENTION

The invention relates to photonic bandgap (PBG) crystals for use in reflecting, guiding and dividing incident electromagnetic radiation. More particularly, the invention relates to photonic reflectors, waveguides and splitters, the reflectors especially for use as radiation shields in microwave ovens and the waveguides and splitters having applications in communication systems. Software based methods for determining design parameters of these devices for desired applications and photonic frequency ranges are also provided.

BACKGROUND OF THE INVENTION

Photonic band gap materials are characterized by the property that they allow electromagnetic waves with a discrete set of frequencies to propagate, while blocking others. The allowed frequencies, as functions of the wave number, form the boundaries of the band gap and the size of the bandgap determines which frequencies are allowed to pass and which frequencies are rejected. Photonic band gaps can be exploited in many ways for practical applications. One such application is as a high-efficiency reflector for all directions and polarizations of photonic radiation (e.g. light, microwave, etc.).

Conventional microwave ovens operate at the ground state frequency radiation of 2.45 GHz. However, the source magnetron also generates radiation at other frequencies with varying intensity. Leakage of radiation is undesirable for health reasons. Most of this radiation is contained by conventional techniques, which are reasonably adequate for lower frequencies, but for higher frequencies suffer from inefficiency and design complications due to the higher penetration power of those frequencies. In addition to the health reasons, the fifth harmonic frequency of 12.25 GHz, which has a significant intensity, interferes with other household appliances (e.g.: phones, televisions) and with communication equipment in aircraft and satellites. For this reason, there has been substantial interest in developing better techniques to prevent this harmonic from leaking from microwave ovens.

There are generally two ways in which microwave energy is supplied to food within the cooking cavity of a microwave oven: by direct feeding to the cavity or via a waveguide. Most oven manufacturers prefer waveguide feeding for its ability to better distribute the energy to the food and for the added design flexibility provided by de-coupling the magnetron location from the cavity geometry. Shielding is employed in certain applications to prevent undesirable leakage of harmful radiation from the cavity. For example, screens are sometimes used in appropriate configurations to prevent radiation leakage. Such structures are satisfactory to block the radiation of lower frequencies, but for higher frequencies they are cumbersome. Because of the greater penetration power of high frequency radiation, shielding of the fifth harmonic requires screens covering most of the outer boundary of the cavity walls. It would therefore be desirable to reduce or eliminate the need for this type of shielding by blocking or suppressing emission of fifth harmonic frequencies from the magnetron itself using an appropriate waveguide mounted reflector device.

U.S. Pat. No. 6,130,780, filed Feb. 19, 1999 by Joannopoulos, et al., discloses an omnidirectional reflector made using a one-dimensional PBG crystal. The bandgap defines a range of frequencies that are reflected for electromagnetic energy incident upon the surface of the crystal. Use of the crystal as a radiation reflector in waveguide-fed microwave ovens or elsewhere is not disclosed.

Photonic bandgap crystals may also be used in the design of waveguides and splitters. The usual design method is based on the introduction of defects or deformities into PBG crystals. These defects may destroy the periodicity of the crystal; for example, in a straight wave guide, periodicity in one dimension is lost. Since the band structure is an outcome of the periodicity, the introduction of defects may alter the band structure in a drastic way. This renders the design process less flexible and subject to some trial and error experimentation.

U.S. Pat. No. 6,941,055, filed Nov. 30, 2004 by Segawa, et al., discloses a photonic bandgap waveguide wherein a defect region of incomplete crystal periodicity is used to guide an optical signal. This optical crystal is for a specific polar geometry and is not applicable as a frequency splitter. The crystal is not disclosed for any particular application and suffers from design complications as a result of the defect-based design methodology.

The simplest geometric configuration exhibiting the band gap property is a stack of dielectric slabs separated by layers of another dielectric. In designing a photonic bandgap reflector, the allowed bandgap frequencies are determined by the eigenvalues of a self-adjoint operator. A widely used algorithm to compute the eiegenvalues is to use the Rayleigh-Ritz method, as described in J. D. Joannopoulos, R. D. Meade and J. N. Winn, *Photonic Crystals* (Princeton University Press, Princeton, N.J., 1995, pp. 127-129), which is hereby incorporated herein by reference. This results in an approximation of the dielectric constant, which in this case is a discontinuous function, by a truncated Fourier series. Partial Fourier sums to discontinuous functions are known to suffer from the Gibbs phenomenon. They produce approximations with oscillations in the neighborhoods of the discontinuities, which do not diminish as the order of the approximation is increased. In the limit of infinitely many plane waves, the variation at each discontinuity does not converge to the jump. This property leads to poor convergence of the method, extending the required computational time and impeding accurate calculations to be performed that are critical for adequate understanding of the properties of the photonic band gap material. As a result, prior art design methods have provided limited accuracy at finite orders consistent with reasonable computational times. More accurate determination of bandgap boundaries therefore has required extended computational time, sometimes in the order of hours or days. Design difficulties arising from a lack of flexibility in this approach have limited the range of practical applications for real-world systems.

In order to design practical photonic bandgap reflector-suppressors, it would therefore be desirable to have a software tool that allows the calculations to be performed efficiently for a specified frequency, physical geometry and dielectric material at a finite order that delivers accurate bandgap boundaries within a reasonable computational time.

The need therefore exists for improved design concepts and design software that result in improved photonic bandgap reflectors, waveguides and splitters.

SUMMARY OF THE INVENTION

According to an aspect of the present invention, there is provided a radiation reflector for a microwave oven comprising a photonic bandgap crystal having a plurality of cells, each cell comprising: two layers of a first material having a first thickness and a first dielectric constant; a second material having a second thickness and a second dielectric constant less than the first dielectric constant, the second material sandwiched between the two layers of the first material and in intimate contact therewith; each cell abutting and in intimate contact with an adjacent cell to create a periodic structure having a plurality of interleaving first and second materials; and, the crystal reflecting at least 75% of microwave power incident to the reflector at a frequency of from 10 to 15 GHz.

According to another aspect of the present invention, there is provided a waveguide comprising a photonic bandgap crystal for use in directing or splitting incident photonic radiation, the waveguide comprising: a block of a first material having a first dielectric constant, the block having a length, a width and a thickness; a guide path for directing or splitting photonic radiation through the crystal, the guide path having a starting point on the width and at least one ending point on the length or width; a plurality of cylindrical holes, each having a longitudinal axis parallel to the thickness and a radius perpendicular thereto, the holes provided along the length and width of the block outside the guide path and arranged in a triangular lattice having a lattice constant, the holes containing a second material having a second dielectric constant less than the first dielectric constant; wherein the first dielectric constant is from 7.4 to 25, the second dielectric constant is from 0.9 to 1.1 and the ratio of the radius to the lattice constant is from 0.45 to 0.495.

According to yet another aspect of the present invention, there is provided a method of determining an upper and a lower boundary of a photonic bandgap using a computer, the method comprising: providing a set of co-ordinates relating to physical dimensions of a photonic bandgap crystal in from a one-dimensional space to a three-dimensional space; providing a dielectric constant for the photonic bandgap crystal; numerically solving Maxwell's equations at both the upper and lower boundaries of the photonic bandgap using a Fourier expansion of solutions to the Maxwell's equations along with an extended Fejér summation for resolving discontinuities in the Fourier expansion at the upper and lower boundaries of the bandgap, the extended Fejér summation producing a set of Fejér weights; multiplying each term of the Fourier expansion by selected Fejér weights from the set of Fejér weights to thereby improve convergence of the Fourier expansion at the upper and lower boundaries of the bandgap; and, displaying a value for the upper and lower boundaries of the bandgap.

Photonic bandgap devices according to the present invention may be designed using one-dimensional, two-dimensional or three-dimensional PBG crystals and combinations thereof. In waveguide fed microwave ovens, one-dimensional PBG crystals offer attractive physical geometries that can be adapted to fit within the confines of a conventional waveguide feeding system and are particularly useful in creating practical reflector-suppressors for high frequency radiation. Two or three dimensional crystals may be used in the design of waveguides and splitters using a design principle based upon arranging a plurality of reflectors in a suitable structure to achieve the desired effect, rather than introducing a defect into the crystal. This advantageously preserves the periodicity of the crystal structure when performing calculations, improving design flexibility and convenience. The computer design methodology reaches convergence quickly, making it less computationally intensive than prior art design methodologies.

Further features of the invention will be described or will become apparent in the course of the following detailed description.

BRIEF DESCRIPTION OF THE DRAWINGS

In order that the invention may be more clearly understood, embodiments thereof will now be described in detail by way of examples, with reference to the accompanying drawings, in which.

DESCRIPTION OF PREFERRED EMBODIMENTS

Computer-Based Design Methodology

Figure 1:
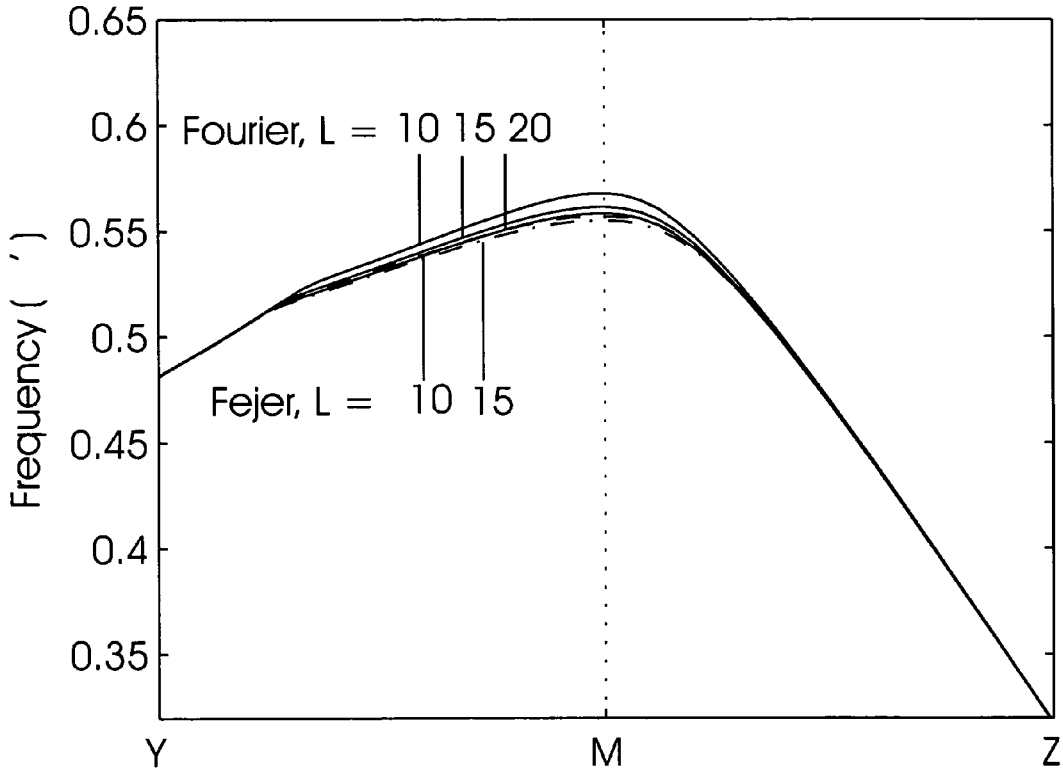
FIG. 1 illustrates convergence of the Fourier and Fejér summations for the TE mode frequency $\omega'=\omega a/2\pi$.

The Rayleigh-Ritz method has been implemented in the past to solve Maxwell's equations and determine the boundaries of the bandgap. However, as previously noted, this method results in a partial Fourier sum to a discontinuous function that suffers from the Gibbs phenomenon, leading to poor convergence. In the prior art, adjustments to the dielectric constant have been used to improve the original numerical scheme, by replacing it with a Gaussian, and by approximating it with a piecewise linear function in the neighborhood of the discontinuity. Fejér sums, obtained by re-grouping the terms in the Fourier series, are known to produce a converging sequence of smoother approximations and eliminate the Gibbs phenomenon in the case of discontinuous functions, as described by R. Courant and D. Hilbert in *Methods of Mathematical* Physics, Vol. I, (Interscience Publishers, Inc., New York, 1953, pp. 102-107), which is incorporated herein by reference. However, in order to extend the original Fejér method to apply to the operators determined by the discontinuous functions involved in Maxwell's equations significant mathematical manipulations are required. These manipulations result in an algorithm that produces lower bounds to the upper bounds obtained by the Rayleigh-Ritz method with plane waves as the basis functions. Alternative basis to plane waves have also been used with some benefit. When implemented using a computer, this algorithm converges more quickly than the Rayleigh-Ritz method, resulting in a considerable computational advantage.

For the photonic bandgap materials of interest, Maxwell's equations can be reduced to $$\nabla \times \left(\frac{1}{\varepsilon(r)} \nabla \times H(r)\right) = \omega^2 H(r) \tag{1}$$

where $\epsilon(r)$ is the dielectric function of the material, H(r) is the magnetic field, and $\omega$ is the frequency of the electromagnetic wave, in units with the speed of light in vacuum being equal to one. The boundary conditions satisfied by H(r) are determined by the geometrical structure of the crystal, which are assumed to be periodic, for the present.

Let $\hat{H}$ be the Hilbert space of the square integrable vector functions covering the region occupied by the crystal, with the scalar product defined by $$(u,v)=\int dr\, u^*(r)\cdot v(r),$$

where the dot denotes the usual scalar product of the vectors in the pertaining Euclidian space. Eq. (1) may be expressed as an eigenvalue equation:

$$(ABA)H=\omega^2 H \tag{2}$$

where $(Au(r)=\nabla\times u(r)$, and $(Bu(r)=\epsilon^{-1}(r)u(r)$. The set of admissible functions, defining the domain of (ABA), is determined by the boundary conditions. For the periodic, and various other boundary conditions of interest, (ABA) is a non-negative operator, in addition to being self-adjoint.

Eq. (2) is usually solved by the Rayleigh-Ritz method. In this method with plane waves as the basis functions, H(r) is expressed as $$H(r) = \sum_{(G\lambda)} h_{(G\lambda)}\phi_{(G\lambda)}(r), \text{ with } \phi_{(G\lambda)}(r) = e_\lambda e^{i(k+G)\cdot r},$$

where k is a vector in the irreducible Brillouin zone, the set of vectors G describes the reciprocal lattice, and $e_\lambda$ are the unit vectors perpendicular to (k+G). The method requires only that the set $\{\phi_{(G\lambda)}\}$ be complete, and included in the domain of (ABA). The advantage of the plane waves is that they form an orthonormal set of the eigenvectors of A, resulting in some computational convenience. The corresponding approximations, $\omega_R^2$, to $\omega^2$ are the eigenvalues of the truncated operator $P_N(ABA)P_N$, with $P_N$ being the orthoprojection, defined by $$P_N u = \sum_{(G\lambda)} \phi_{(G\lambda)}\langle\phi_{(G\lambda)}, u\rangle, \text{ where } \langle\phi_{(G\lambda)}, u\rangle = \int dr\,\phi_{(G\lambda)}*(r)u(r)$$

are the Fourier coefficients of u.

It follows from the eigenvalue equation, $P_N(ABA)u=\lambda' u$, that $u=P_N u$, except, possibly, for $\lambda'=0$, which arises only for k=0, where it can be shown to be true, independently. Hence, the sets of the eigenvalues, and the corresponding eigenvectors, of $P_N(ABA)P_N$ and $P_N(ABA)$ are identical. As shown by C. C Tai, S. R. Vatsya and H. O. Pritchard in "Related Upper and Lower Bounds to Atomic Binding Energies" *Intern. J. Quant. Chem.*, vol. 46, pp. 675-688 (1993), which is incorporated herein by reference, the eigenvalue equation, in either case, reduces to the matrix equation:

$$\sum_{(G\lambda)'} \Theta^k_{(G\lambda)(G\lambda)'} h_{(G\lambda)'} = \omega_R^2 h_{(G\lambda)} \tag{3}$$

where $$\Theta^k_{(G\lambda)(G\lambda)'} = [(k+G)\times e_\lambda]\cdot[(k+G')\times e_{\lambda'}]\varepsilon^{-1}_{GG'}$$

with $\epsilon_{G\,G'}^{-1}$ being the Fourier coefficients of $\epsilon^{-1}$: $\epsilon_{G\,G'}^{-1}=\langle\phi_{(G\lambda)}, \epsilon^{-1}\phi_{(G\lambda)'}\rangle$.

Now, consider the function $v=(ABA)u$, with an arbitrary admissible function u in $\hat{H}$, which implies that v is in $\hat{H}$. In view of the completeness of the plane waves, one has that $$\|P_N v - v\| \xrightarrow[N\to\infty]{} 0,$$

where $\|\ldots\|$ denotes the norm in $\hat{H}$. If v is discontinuous, $P_N v$ encounters the Gibbs phenomenon, but the set of points of non-convergence shrinks to a set of measure zero, preserving the convergence with respect to the norm.

For the one dimensional case, the sequence of the Fejér sums, $S_N$, which are the arithmetic means of the partial Fourier sums, $s_n$, i.e., $$S_N = \frac{1}{N}\sum_{n=-N}^{N} s_n,$$

converges uniformly to v. In particular, $S_N$ do not encounter the Gibbs phenomenon. The sums $S_N$ can be expressed as $$S_N = \sum_{n=-N}^{N} \xi_n \phi'_n\langle\phi'_n, v\rangle = q_N v,$$

where $\phi_n'$ are the plane waves in one dimension, $[\phi_n',v]$ is the n-th Fourier coefficient of v, $\xi_0=1$, and $\xi_n=(N-n+1)/N$, for $n\geqq 1$. For a multi-dimensional case, the Fejér sums are given by $$S_{L\ldots M} = \sum_{l=-L}^{L}\cdots\sum_{m=-M}^{M} \xi_l\ldots\xi_m\phi'_l\ldots\phi'_m\langle\phi'_l\ldots\phi'_m, v\rangle = Q_{L\ldots M}v.$$

The polarization vector has no effect on the values of the coefficients $\xi_n$. Thus the Fejér sums, $Q_N v$, formed from the Fourier sums $P_N v$, are given by $$Q_N v = \sum_{(G\lambda)} \xi_{(G\lambda)} \phi_{(G\lambda)} \langle \phi_{(G\lambda)}, v \rangle = P_N Q_N v \tag{4}$$

Let $\omega_F^2$ be the eigenvalues of the operator $Q_N(ABA)$, equivalently, $Q_N(ABA)P_N$. The eigenvalue equation is equivalent to the matrix equation:

$$\sum_{(G\lambda)'} \xi_{(G\lambda)} \Theta^k_{(G\lambda)(G\lambda)'} h_{(G\lambda)'} = \omega_F^2 h_{(G\lambda)},$$

which can be symmetrized to $$\sum_{(G\lambda)'} \sqrt{\xi_{(G\lambda)}}\, \Theta^k_{(G\lambda)(G\lambda)'} \sqrt{\xi_{(G\lambda)'}}\, g_{(G\lambda)'} = \omega_F^2 g_{(G\lambda)} \tag{5}$$

where $g_{(G\lambda)}=h_{(G\lambda)}/\sqrt{\xi_{(G\lambda)}}$. Eq. (5) is the matrix representation of the operator $\sqrt{Q_N}(ABA)\sqrt{Q_N}$.

Since $\xi_{(G\lambda)} \leqq 1$, the matrix on the left side of (5) is bounded from above by the matrix on the left side of (3), which implies that $\omega_F \leqq \omega_R$. Since $\omega_R$ provide upper bounds to the exact eigenvalues, $\omega_F$ are expected to be more accurate, at finite orders.

In addition to improving the point-wise convergence, the Fejér sums preserve the convergence with respect to the norm, i.e., $$\|Q_N v - v\| \xrightarrow[N\to\infty]{} 0.$$

However, the value of $\|P_N v - v\|$ is the smallest possible for a given N. Convergence with respect to the norm, in fact the operator norm, in an appropriate Hilbert space, is important for the convergence of $\omega_R$ to the exact values.

The present extension makes a minimal use of the Fejér summation theorem, to eliminate the effects of the Gibbs phenomenon, without altering the value of the norm more than necessary. In addition, this approach produces converging approximations to the eigenvalues bounded from above by the Rayleigh-Ritz values, improving their accuracy, and thus, the rate of convergence, and the efficiency of the algorithm.

EXAMPLE 1

The method was applied to a standard test case, of a square lattice of cylindrical dielectric columns, with $\epsilon=8.9$, embedded in air with $\epsilon=1$. The lattice was assumed to be homogeneous in the z-direction, and periodic along x and y-axes, with lattice constant equal to a, and radius of the dielectric r=0.2a. In this structure, the two polarization modes decouple into trans-electric (TE) and the trans-magnetic (TM), enabling one to obtain the solutions separately.

For the TE mode, only the z-component of the magnetic field is non-zero. The matrix with elements $\Theta_{(G\lambda)(G\lambda)'}{}^k$, in this case reduces to $C^{TE}$ with elements $$C_{mn}{}^{TE} = \epsilon_{mn}{}^{-1}[(k+m)\cdot(k+n)]$$

where m,n are the integer vectors with components $m_x, m_y$ and $n_x$, $n_y$, respectively, and $\epsilon_{mn}{}^{-1}$ is the two-dimensional Fourier coefficient of $\epsilon^{-1}$. Here, $m_x, m_y, n_x, n_y = -L$ to L, and thus, the size of the basis set is equal to $(2L+1)^2=N$. In the extended Fejér case, the elements $C_{mn}{}^{TE}$ are multiplied by $\zeta_{mn}=\sqrt{\xi_{m_x}\xi_{m_y}\xi_{n_x}\xi_{n_y}}$.

For the TM case, the x and y-components of the magnetic field are non-zero. This increases the rank of the matrix in (5) by a factor of two. However, an equation may be obtained for the only non-zero, z-component, of the electric field, which in the present case reduces to $$\frac{1}{\varepsilon(r)}\left(\frac{\partial^2}{\partial x^2} + \frac{\partial^2}{\partial y^2}\right)E(r) = -\omega^2 E(r)$$

With the plane wave basis, $\omega_R^2$ can be shown to be the eigenvalues of the symmetric matrix with elements $$C_{mn}{}^{TM} = \epsilon_{mn}{}^{-1}|k+m||k+n|$$

As above, $\omega_F^2$ are the eigenvalues of the matrix with elements $\zeta_{mn}C_{mn}{}^{TM}$.

Calculations were carried out for the three lowest frequencies, for both, the TE and the TM mode. In all the cases considered, the convergence of the approximations obtained by the extended Fejér summation method was found to be considerably faster than the standard use of the plane waves based on the Fourier summation, resulting in significant savings in memory requirements and computing time.

Figure 2:
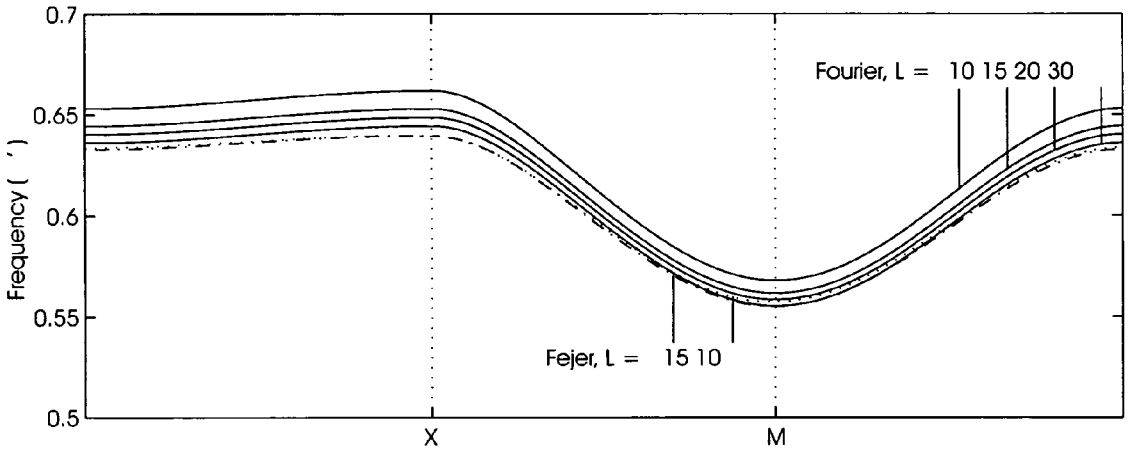
FIG. 2 illustrates convergence of the Fourier and Fejér summations for the TM mode frequency $\omega'=\omega a/2\pi$.
Figure 3:
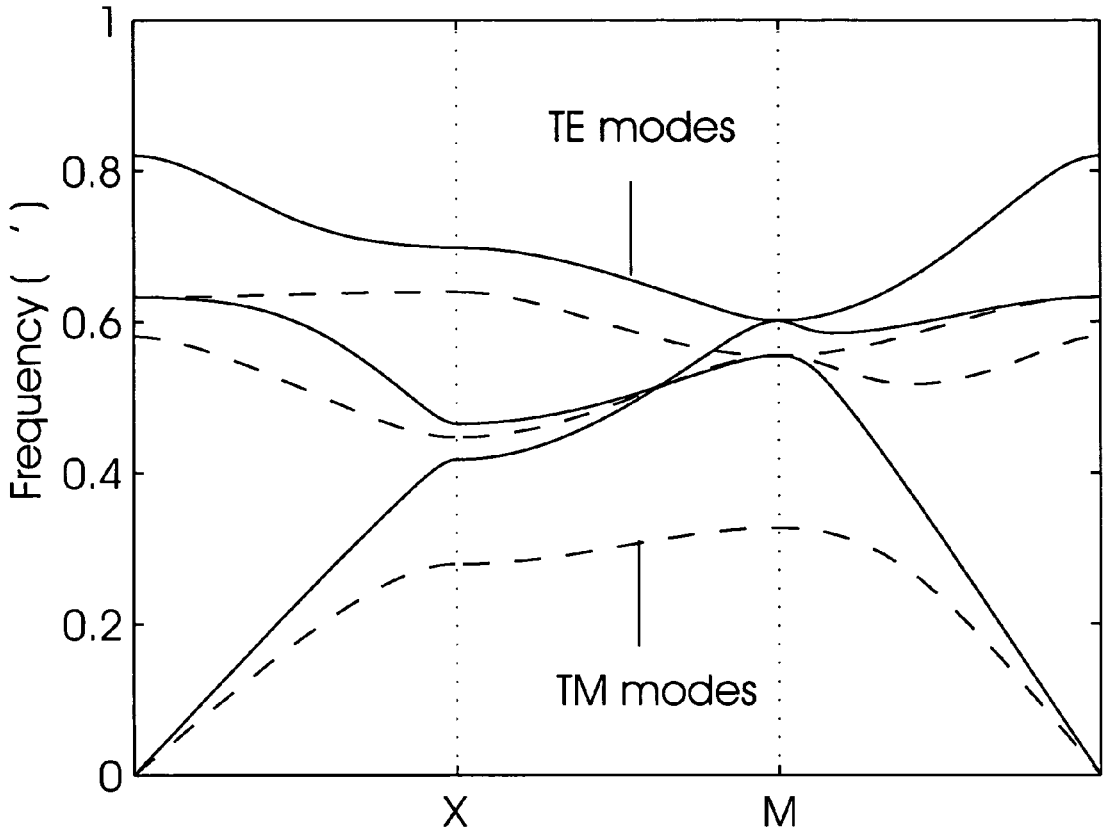
FIG. 3 illustrates the photonic band structure for a square array of dielectric columns with $\rho=0.2$, $\epsilon=8.9$, $\omega'=\omega a/2\pi$, computed by the extended Fejér summation with L=15.

In describing FIGS. 1 to 3, the Brillouin zone of a triangular lattice is hexagonal in structure and its irreducible part the triangle joining the two adjacent corners X and M of the perimeter to the center Γ. The point Y is midway between M and X and the point Z is midway between M and Γ.

FIG. 1 shows the results obtained by both methods with several L values, for the lowest eigenvalue, in the case of the TE mode. This is one of the cases where the performance of the Fourier summation was found to be better than the other cases considered. Outside these ranges, the values by both methods were found to be almost identical, starting at about L=5. Close to the point M, on both sides, the values obtained by the Fourier summation decrease noticeably up to L=20, converging towards the values obtained by the Fejér method obtained with L=15, which show little change beyond L=10.

FIG. 2 shows the results for the third lowest frequency in TM mode, where the convergence of the Fourier summation was found to be the slowest among all the cases considered. In this case, the convergence properties of the Fejér summation are about the same as all the other cases, i.e., it yielded quite accurate values with L=10 to 15. The values obtained by the Fourier summation, in this case, show significant decrease at least up to L=30, slowly converging towards the Fejér values.

For comparison with the literature values [see, for example, J. D. Joannopoulos, R. D. Meade and J. N. Winn, *Photonic Crystals* (Princeton University Press, Princeton, N.J., 1995, pp. 56-57), which is incorporated herein by reference], FIG. 3 shows the band structure obtained by the present extension of the Fejér summation, computed with L=15, which is almost identical to the one obtained with L=10.

The convergence behavior of the two methods, the Fourier and the extended Fejér summation, for all the cases considered, was found to be between the two widest ranging cases, shown in FIG. 1 and FIG. 2. In all cases, the approximations obtained by the present extension converge considerably more rapidly than the standard use of plane waves. Thus, this method makes a more efficient use of the plane waves to determine the photonic band structure, requiring a smaller basis set. Since the computing time increases very rapidly with increase in the size of the basis, the Fejér summation yielded accurate values in a fraction of the time needed to obtain comparable results by the Fourier summation method with reduced memory requirements.

The foregoing computer based design methodology may be used to design photonic bandgap reflectors, waveguides and splitters, embodiments of which will be described in greater detail below.

Photonic Bandgap Reflector

A photonic bandgap reflector based on a one-dimensional PBG crystal was designed using an adaptation of the foregoing computer-based design methodology. The design methodology allows for a great deal of freedom in selecting the material. The basic requirement is that the dielectric constant differs significantly from air. Technical considerations are mainly that the material should be able to withstand the heat generated and it should be economical and conveniently machinable. Further, it is desirable for a device of this type to have a small amount of material so that the absorption of the radiation at other frequencies is minimal. Since PBG crystals are constituted with a small amount of material, they are pre-eminently suitable for developing such reflector devices.

The design methodology for the one dimensional case was adapted by considering a periodic structure of slabs of dielectric material. The periodic structure may be described, in units of the lattice constant, a, by $$\varepsilon(z) = \varepsilon_{out},\ -\frac{1}{2} \le z \le -\frac{\rho}{2},\ \frac{1}{2} \ge z \ge \frac{\rho}{2}, \qquad (6)$$
$$\varepsilon(z) = \varepsilon_{in},\ -\frac{\rho}{2} \le z \le \frac{\rho}{2}$$

with complete translational symmetry in x and y directions. This describes a stack of dielectric plates of thickness equal to $(1-\rho)$, separated by air of thickness equal to $\rho$, with the lattice constant normalized to unity. Propagation of the electromagnetic waves in z direction is of interest. The magnetic field can be assumed to be along one of the orthogonal axes, which is taken to be the x-axis, and the electric field is along the y-axis.

In this case, the solution H(r) can be expressed as $$H(r)=\exp[k_{\|}\cdot r_{\|}]\exp[k_z z]u(z)\hat{x}, \qquad (7)$$

where $\hat{x}$ is the unit vector along the x-axis and $k_z$ is the wave-vector along the z-axis. The wave-vector $k_{\|}$ is arbitrary in the x-y plane with the corresponding position vector $r_{\|}$. For normal incidence $k_{\|}=0$. Since it will cause no confusion, the subscript z from $k_z$ will be dropped.

Substitution for H(r) in Eq. (1) yields $$\left(ik + \frac{\partial}{\partial z}\right)\left[\frac{1}{\varepsilon(z)}\left(ik + \frac{\partial}{\partial z}\right)\right]u(z) = -\omega^2(k)\,u(z) \qquad (8)$$

Since u(z) is periodic with unit period, it can be expressed as $$u(z) = \sum_{n=-\infty}^{\infty} \alpha_n \exp[2\pi i n z].$$

For numerical computations, the summation is truncated at some finite value N.

Let $\alpha$ be the vector with elements $\alpha_n$ and let M be the matrix with elements $$M_{nm} = M_{mn} = (k + 2\pi n)(k + 2\pi m)\int_{-1/2}^{1/2} \frac{1}{\varepsilon(z)} \exp[2\pi i(m-n)] \qquad (9)$$
$$= (k + 2\pi n)(k + 2\pi m)\left(\frac{1}{\varepsilon_{in}} - \frac{1}{\varepsilon_{out}}\right)\sin[\pi(n-m)\rho],$$
$$n, m = -N, \ldots, N.$$

Approximate solutions of Eq. (8) can be obtained by solving the matrix eigenvalue equation, $$M\alpha=\omega^2(k)\alpha \qquad (10)$$

This is the standard Rayleigh-Ritz method with plane wave basis set. While convenient, use of the plane wave basis encounters slow convergence problem owing to the Gibbs phenomenon as indicated above. Convergence can be substantially improved by modifying the matrix M to a symmetric matrix M' with elements $$M'_{nm}=\zeta_{nm}M_{nm}$$

and replacing M by M' in Eq. (10).

Parameters can be calculated for an arbitrary wavelength from the normalized frequency. The lattice constant a is given by $$a=\lambda\omega_{mid}$$

where $\lambda$ is the wavelength of the electromagnetic wave to be blocked and $\omega_{mid}$ is the midpoint of the band gap. While $\omega_{mid}$ can be taken to be equal to any point inside the band gap, it is most suitable to take it as the midpoint.

Now, the thickness $\tau_\epsilon$ of the dielectric slabs and the separation $\tau_{air}$ between them are given by $$\tau_\epsilon=(1-\rho)a,\ \tau_{air}=\rho a, \qquad (11)$$

respectively. The wavelength band blocked is given by $$\lambda_{\min} = \frac{a}{\omega_{\max}} < \lambda < \frac{a}{\omega_{\min}} = \lambda_{\max} \qquad (12)$$

where $\omega_{max}$ and $\omega_{min}$ are the upper and lower edges of the band gap with respect to the normalized frequency. The blocked frequency band is given by the wavelength band:

$$\nu_{\min} = \frac{c}{\lambda_{\max}} < \nu < \frac{c}{\lambda_{\min}} = \nu_{\max} \qquad (13)$$

where c is the speed of light.

The foregoing adaptation of the computer based design methodology for one-dimensional photonic reflectors was used to design reflector-suppressors for installation in the waveguide of a waveguide-fed microwave oven. A number of potential designs were evaluated for their efficacy in suppressing frequencies in the microwave range and particularly frequencies of about 12 GHz to correspond with the fifth harmonic frequency emitted by microwave oven magnetrons. The results of these evaluations for a variety of materials (having varying dielectric constants $\epsilon$) and physical geometries are provided in Table 1.

TABLE 1

Suppressed bandgap frequency range for varying material and geometry

| $\epsilon$ | $\rho$ | Dielectric thickness (mm) | Air thickness (mm) | $\nu_{min}$ (GHz) | $\nu_{max}$ (GHz) |
|---|---|---|---|---|---|
| 1.1 | 0.5 | 5.98 | 5.98 | 12.06 | 12.44 |
| 1.1 | 0.7 | 3.62 | 8.447 | 12.096 | 12.404 |
| 2.0 | 0.5 | 5.07 | 5.07 | 10.95 | 13.55 |
| 2.0 | 0.7 | 3.26 | 7.61 | 11.01 | 13.50 |
| 3.5 | 0.5 | 4.237 | 4.237 | 10.11 | 14.40 |
| 3.5 | 0.7 | 2.91 | 6.79 | 9.88 | 14.60 |
| 5.0 | 0.5 | 3.72 | 3.72 | 9.70 | 14.80 |
| 5.0 | 0.7 | 2.68 | 6.26 | 9.20 | 15.30 |
| 7.0 | 0.5 | 3.26 | 3.26 | 9.41 | 15.09 |
| 7.0 | 0.7 | 2.46 | 5.75 | 8.61 | 15.89 |
| 5.9 | 0.62 | 3.00 | 4.895 | 9.05 | 15.45 |
| 4.0 | 0.676 | 3.00 | 6.258 | 9.60 | 14.90 |
| 5.0 | 0.648 | 3.00 | 5.529 | 9.23 | 15.27 |
| 6.0 | 0.617 | 3.00 | 4.83 | 9.03 | 15.47 |
| 7.0 | 0.577 | 3.00 | 4.095 | 9.02 | 15.48 |

As is clear from Table 1, a band gap opens for all dielectric constant values. Although a bandgap opens at the lowest value of the dielectric constant, 1.1, it is too narrow for the fabrication limits of a practical device. However, the band gap for the dielectric constant ranging from 2 to 7 is quite wide, which provides a great deal of flexibility in the selection of materials and geometries.

EXAMPLE 2

Figure 12:
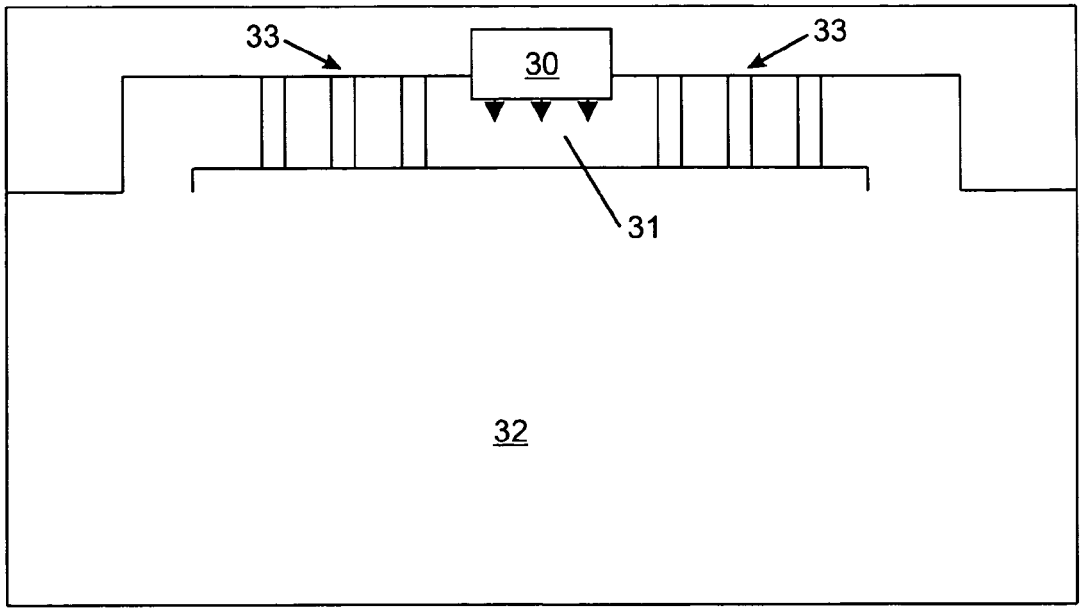
FIG. 12 is a schematic illustration of a one-dimensional PBG crystal installed within the waveguide of a microwave oven for use as a radiation reflector-suppressor according to the present invention; and, FIG. 13 provides a schematic layout of the experimental equipment used to test one-dimensional crystals.

The foregoing evaluations were used to select design parameters for the experimental validation of a one-dimensional PBG crystal suitable for use as a radiation reflector-suppressor in a waveguide-fed microwave oven. A schematic showing the placement of the one-dimensional PBG crystal within the waveguide of the microwave oven is provided in FIG. 12. The source (30) comprises a magnetron and emits microwave frequency energy into the waveguide (31) for distribution to the cooking cavity (32). A one-dimensional PBG crystal (33) is provided within the waveguide (31) on both sides of the source (30). The properties of the crystal (33) are selected in order to reflect undesirable frequencies back to the source, thus preventing them from escaping from the waveguide (31) into the cavity (32). In one embodiment, the crystal (33) is closely coupled to the source (30). so that the undesirable frequencies are suppressed from being emitted. Thus, the undesirable microwave frequencies (particularly the higher frequencies associated with the fifth harmonic) are prevented from entering the cavity (32), thereby improving the safety of the microwave oven and reducing the stringency of conventional shielding requirements. The efficiency of the oven is also increased, as the suppressed radiation is re-emitted at desirable cooking frequencies.

One-dimensional photonic band gap crystals were made of a dielectric material and a plastic material sandwiched together. The dielectric material used was Eccostock CK, a low loss ceramic with controlled dielectric constants ranging from 1.7 to 15, produced by Emerson & Cuming. Experiments were conducted with crystals made with material of the dielectric constants 2, 5, and 7 to verify the calculations and to determine the precision of fabrication. The air gap was replaced with Delrin™ plastic, which has a dielectric constant close to one at frequencies in the GHz range. The width of the band gap increases with increase in the dielectric constant of the material used, as indicated by Table 1.

The efficiency of crystals with a varying number of cells was investigated. Although the calculated results correspond to a crystal with infinitely many cells, in practice it was found that only a few cells are needed to perform close to the calculated efficiency. The highest level of efficiency of the crystals tested was achieved with a seven-cell crystal made with material of dielectric constant equal to seven, but the performance of five-cell crystals was found to be close. Decrease in the dielectric constant of the material had little effect on performance as long as the band gap was sufficiently wide to cover the usual deficiencies in fabrication.

Figure 4:
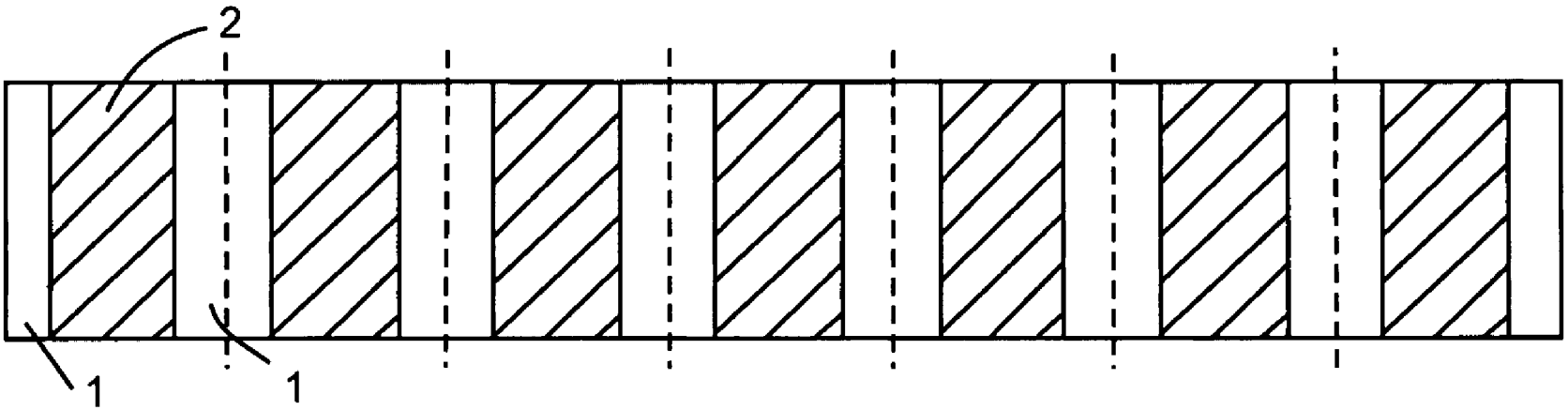
FIG. 4 provides a schematic illustration of a 7-cell waveguide one-dimensional photonic crystal.

A seven-cell crystal is illustrated in FIG. 4. Each cell comprises two layers of a first material (1) and a second material (2) that is sandwiched between the two layers of the first material (1) and in intimate contact therewith. The cells abut one another and are in intimate contact with one another. The seven-cell crystal shown has fourteen layers of the first material (1) and seven layers of the second material (2). The interior layers of the first material (1) are provided in a continuous slab that has a thickness double that of the individual layers. Each layer of the first material (1) has a thickness of 1.5 mm and the interior slabs therefore have a thickness of 3 mm. The second material is chosen to have a dielectric constant approximately the same as air; for example, in the embodiment tested the second material was Delrin™ plastic. The thickness of the second material was about 4.095 mm. The second material is provided in intimate contact with the first material to create a repeating periodic structure of seven cells with a geometry approximating the last entry in Table 1.

Figure 13:
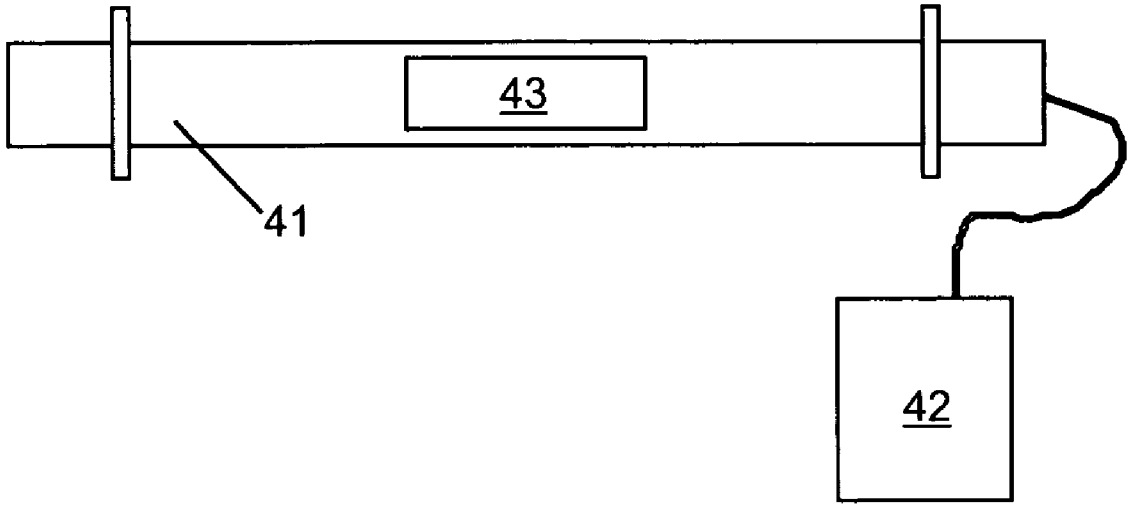

A schematic of the experimental setup is illustrated in FIG. 13. A power supply (not shown) comprising dielectric resonator oscillators produced by WiseWave Technologies Inc. was connected to a microwave source (not shown). Experiments were conducted with sources of frequencies of 10, 12, and 15 GHz and each source generated radiation in a narrow band about one central frequency. The microwave source was coupled to one end of a six inch WR-75 type waveguide (41) having adequate properties for frequencies ranging from 10 to 15 GHz. Adapters were used to connect the waveguide (41) to both the microwave source and a detector (42). The detector (42) comprised a 20 GHz microwave frequency counter and power detector from Agilent Technologies that was used to determine the transmitted power. The one-dimensional crystal being tested (43) was placed within the waveguide (41) while determining its transmittance.

Since the intensity of the incident radiation must vary from one end of the material to the other due to attenuation, determination of the reflective efficiency should take this into account. The attenuation coefficient of the material used to fabricate the crystals was determined by measuring the fraction of the intensity transmitted through solid blocks of sizes varying from 3 to 18 mm of dielectric constants of five and seven placed at a number of locations in the waveguide in increments of 5 mm with respect to the source at all three frequencies. There was noticeable variation in the transmitted intensity with solid blocks placed at different locations, due to interface effects. The transmitted intensity was averaged to reduce these effects. Average transmitted intensity per unit distance of the material indicated little impact of the frequency and the dielectric constant.

The attenuation coefficient $\alpha$ is given by $$I_t = I_0 \exp[-\alpha d], \quad (14)$$

where $I_0$ is the incident power and $I_t$ is the transmitted power through the block of thickness d. Table 2 shows the average transmitted intensity through a 17.3 mm block of dielectric constant $\epsilon$=7 and the calculated attenuation coefficient. The average of these values, 0.023 $mm^{-1}$, was about the same as the attenuation coefficient obtained by averaging over a large data size.

TABLE 2

| Transmitted power through block size = 17.3 mm, $\epsilon$ = 7, frequencies 10–15 GHz | | | |
|---|---|---|---|
| Frequency (GHz) | Incident power (mW) | Average Transmitted power (mW) | Attenuation Coefficient ($mm^{-1}$) |
| 10 | 3.2 | 2.1 | 0.024 |
| 12 | 2.3 | 1.58 | 0.022 |
| 15 | 2.4 | 1.61 | 0.023 |

The effect of attenuation was taken into account by assuming the incident power to be the median power, i.e., the power attenuated by half of the crystal material. The power for each frequency source incident to the crystal is listed in Table 2 and at the exit end it is less than the median. Any further refinement was not warranted by the experimental accuracy, as the source power showed variations of about 1% in repeat experiments. Reflected power was obtained by subtracting the transmitted power from the median, and the reflectivity is the fraction of the median power reflected. The values of the median power, average transmitted power and the percentage reflected power as well as the calculated efficiency are listed in Tables 3-a and 3-b for the 5-cell and the 7-cell crystal, respectively.

As indicated by Tables 3-a and 3-b, the efficiency of the crystal increases substantially from 5-cell to 7-cell at about the middle of the gap (i.e. 12 GHz), being close to 100% for the 7-cell crystal. Frequencies of 10 GHz and 15 GHz are close to the band gap boundaries (15 GHz being closer), as indicated by Table 1. Fabrication imperfections can move the band gap somewhat. It appears from the results that 15 GHz is not well within the band gap of the fabricated crystal while 10 GHz is. In both cases, the 7-cell crystal demonstrates higher reflective ability than the 5-cell, as is the case with 12 GHz. This is commensurate with expectation. Since the fabrication imperfections are expected to leave 12 GHz well within the band gap, the corresponding results are more reliable. Various phenomena become relevant near the band gap boundaries, accounting for deviations from the theoretical results. Accounting for the experimental errors and variations, it is safe to conclude that the efficiency of the 7-cell crystal of dielectric constant 7 for the frequencies well within the band gap exceeds 98%.

TABLE 3a

| Transmitted power through a 5 cell crystal, $\epsilon$ = 7, frequencies 10–15 GHz | | | |
|---|---|---|---|
| Frequency (GHz) | Median Incident power (mW) | Average Transmitted power (mW) | Reflected power (%) |
| 10 | 2.69 | 0.034 | 98.74 |
| 12 | 1.93 | 0.134 | 93.06 |
| 15 | 2.02 | 0.482 | 76.14 |

TABLE 3b

| Transmitted power through a 7 cell crystal, $\epsilon$ = 7, frequencies 10–15 GHz | | | |
|---|---|---|---|
| Frequency (GHz) | Median Incident power (mW) | Average Transmitted power (mW) | Reflected power (%) |
| 10 | 2.51 | 0.011 | 99.56 |
| 12 | 1.81 | 0.016 | 99.12 |
| 15 | 1.88 | 0.423 | 77.5 |

From the foregoing experiments, the design parameters of a radiation reflector-suppressor for use in a waveguide-fed microwave oven were verified. The fifth harmonic frequency of 12.25 GHz (about 12 GHz) was targeted for the middle of the bandgap. The results indicate that the reflective efficiency of these devices is close to the expectation based on calculations performed using the computer-based design methodology. It was found that the performance of a 7-cell crystal made with a material having a dielectric constant of 7 suppresses radiation at a frequency of about 12 GHz with an efficiency of 98%. This level of performance far exceeds conventional devices. The radiation suppressor also has a geometry suitable for convenient insertion within the waveguide of a conventional microwave oven. Although calculations and experiments were focused on the 12 GHz frequency, the results can be used to fabricate reflectors, waveguides and related devices for other frequencies, particularly for applications in the communication industry.

Photonic Waveguide and Splitter

The waveguide or splitter generally comprises a rectangular block of a dielectric material with a length, width and thickness having a plurality of cylindrical holes machined out of one face of the block. The cylindrical holes have a length parallel to the thickness of the block and a radius perpendicular to the thickness. The cylindrical holes may be filled with air or with a material having a dielectric constant less than that of the block. For example, the holes may be filled with a Delrin™ plastic material. The holes are machined in a triangular lattice pattern that is characterized by a lattice constant, a. A guide path is created by omitting certain holes from the lattice pattern, thereby leaving a solid path of dielectric material. The path is bounded by two reflectors, one on each side. The guide path generally starts on a width of the block and terminates with at least one point on either the length or width of the block. The guide path may have any suitable shape and may be, for example, straight, bent, Y-shaped or pitchfork shaped.

Photonic radiation incident to the width of the block enters the guide path at its starting point and is reflected along the guide path in the desired direction by the holes. Some of the incident radiation is trapped within the guide path by internal reflection and this represents an efficiency loss. In the Y-shaped and pitchfork shaped guide paths, the radiation is split at an intersection in the guide path and thereafter travels in separate directions. By selecting materials and geometries, the branches of the guide path at the junction(s) may function as one-dimensional PBG crystals having different bandgap properties, thereby causing different frequencies of radiation to be transmitted along each branch. In this embodiment, there is a separation of radiation of differing frequencies as well as a splitting and re-direction of the incident radiation. These types of waveguides and splitters can be used effectively in, for example, communications equipment functioning in visible, infrared, microwave or millimeter wavelength ranges.

The first dielectric constant (i.e. the dielectric constant of the block) is selected according to the desired frequencies being guided or split. Suitable materials to fabricate waveguides or splitters in the frequency range covering the optical and including up to far infrared are $Si_3N_4$, Si, GaAs and InP with dielectric constants 7.4, 11.4, 12.35 and 12.6 respectively. Synthetic materials having higher dielectric constants (e.g. $\epsilon$=20, 25, 30, etc.) may also be used. For microwave frequencies, a ceramic material with a dielectric constant of 12.0 can be used. A range of design parameters for a two-dimensional PBG crystal can be calculated using the previously described computer-based design methodology. These calculations and some results are summarized in the following Example.

EXAMPLE 3

In the computer based design methodology, the lattice constant a, and the hole radius r are given by $$a = \frac{v\omega'}{c} \qquad (15)$$

$$r = \rho a$$

where $\nu$ is the frequency of the microwaves, $\rho$ is the ratio of the hole-radius and the lattice constant and $\omega'$ is the normalized frequency determined from the band gap.

In order to determine $\omega'$ and the optimal value of $\rho$, calculations were carried out as previously described at several values of $\rho$ and $\epsilon$. The results of these calculations are summarized in Table 4.

TABLE 4

Lowest Bandgap Width for varying values of $\rho$ and $\epsilon$.

| | Gap width | | | | | |
|---|---|---|---|---|---|---|
| $\rho$ | Si $\epsilon$ = 11.4 | GaAs $\epsilon$ = 12.35 | InP $\epsilon$ = 12.6 | Synthetic $\epsilon$ = 20 | Synthetic $\epsilon$ = 25 | Synthetic $\epsilon$ = 30 |
| 0.470 | 0.078 | 0.082 | 0.083 | 0.093 | 0.093 | 0.091 |
| 0.475 | 0.083 | 0.095 | 0.096 | 0.111 | 0.111 | 0.109 |
| 0.480 | 0.077 | 0.093 | 0.096 | 0.130 | 0.122 | 0.107 |

Referring to Table 4, the optimum width with respect to $\rho$ is obtained at about $\rho$=0.475 for GaAs, Silicon and InP. The value of $\rho$, where the optimum width occurs increases as $\epsilon$ increases. For $\epsilon$ close to 20, optimum bandwidth is likely to be located beyond $\rho$=0.480. However, a crystal with $\rho$>0.480 will have very little structural strength. The widest gap is desirable for the present set of devices to ensure the prohibition of passage of the widest frequency band centered about the central frequency and to minimize the effects of the inaccuracies in the fabrication. However, reasonably good performance can be obtained with $\rho$=0.475 for all materials while still maintaining sufficient structural strength to permit fabrication. If convenient, the value of $\rho$ may be taken less than 0.475, to obtain thicker walls, and still construct a useable reflector.

In addition, bandgap calculations were carried out for silicon nitride ($Si_3N_4$). Silicon nitride has dielectric constant equal to 7.4 and provides a very narrow band gap. The gap width is only 0.014 at $\rho$=0.460 and it almost diminishes at $\rho$=0.475. At lower dielectric constants, the band gap is absent at all values of $\rho$ above 0.475. For $\epsilon$ close to 7.4, a value lower than 0.450 should be assumed for $\rho$. However, the band gap for this value of the dielectric constant is quite narrow, resulting in serious fabrication accuracy constraints. Therefore, only materials with $\epsilon$ larger than 7.4 are expected to have an exploitable band gap in triangular lattice formation.

The tables below show the lattice constants and the diameters of the holes, together with the width of the thinnest part of the wall between two holes, for several normalized frequencies between the lower and the upper edges of the gap for materials considered above. These parameters are generated in the optical, infrared, far-infrared and the microwave regimes.

Table 5 lists values of the lattice constant a, the hole diameter $\phi$ and the wall thickness d for synthetic materials at 9.8 GHz, which is in the microwave regime. Table 6 documents the reflector parameters for Si, GaAs and InP, at the wavelength of 532 nm. Tables 7 and 8 record the values for these three dielectric materials at wavelengths of 1060 nm and 10600 nm respectively, which are in the infrared and the far-infrared regions.

TABLE 5

Lattice constant a, diameter $\phi$ and wall thickness d for reflectors of synthetic materials at $\nu$ = 9.8 GHz.

| | $\epsilon$ = 13.0 | $\epsilon$ = 20.0 | $\epsilon$ = 25 |
|---|---|---|---|
| $\omega'$ | 0.4304 | 0.3520 | 0.3170 |
| a (cm) | 1.3167 | 1.0768 | 0.9698 |
| $\phi$ (cm) | 1.2508 | 1.0230 | 0.9213 |
| d (cm) | 0.0658 | 0.0538 | 0.0485 |
| $\omega'$ | 0.4547 | 0.3797 | 0.3448 |
| a (cm) | 1.3909 | 1.1617 | 1.0547 |
| $\phi$ (cm) | 1.3214 | 1.1036 | 1.0019 |
| d (cm) | 0.0695 | 0.0581 | 0.0528 |
| $\omega'$ | 0.4789 | 0.4075 | 0.3725 |
| a (cm) | 1.4652 | 1.2466 | 1.1395 |
| $\phi$ (cm) | 1.3919 | 1.1843 | 1.0826 |
| d (cm) | 0.0733 | 0.0623 | 0.0569 |
| $\omega'$ | 0.5032 | 0.4353 | 0.4002 |
| a (cm) | 1.5395 | 1.3315 | 1.2244 |
| $\phi$ (cm) | 1.4625 | 1.2649 | 1.1632 |
| d (cm) | 0.0770 | 0.0666 | 0.0612 |
| $\omega'$ | 0.5275 | 0.4630 | 0.4280 |
| a (cm) | 1.6137 | 1.4164 | 1.3093 |
| $\phi$ (cm) | 1.5330 | 1.3456 | 1.2439 |
| d (cm) | 0.0807 | 0.0708 | 0.0654 |

TABLE 6

Lattice constant a, diameter ϕ and wall thickness d for reflectors of Si, GaAs and InP at λ = 532 nm.

| | Silicon ε = 11.4 | GaAs ε = 12.35 | InP ε = 12.6 |
|---|---|---|---|
| ω' | 0.4570 | 0.4400 | 0.4360 |
| a (nm) | 243.1240 | 234.0800 | 231.9520 |
| ϕ (nm) | 230.9678 | 222.3760 | 220.3544 |
| d (nm) | 12.1562 | 11.7040 | 11.5976 |
| ω' | 0.4778 | 0.4638 | 0.4600 |
| a (nm) | 254.1896 | 246.7416 | 244.7200 |
| ϕ (nm) | 241.4801 | 234.4045 | 232.4840 |
| d (nm) | 12.7095 | 12.3371 | 12.2360 |
| ω' | 0.4985 | 0.4875 | 0.4840 |
| a (nm) | 265.2020 | 259.3500 | 257.4880 |
| ϕ (nm) | 251.9419 | 246.3825 | 244.6136 |
| d (nm) | 13.2601 | 12.9675 | 12.8744 |
| ω' | 0.5192 | 0.5112 | 0.5080 |
| a (nm) | 276.2144 | 271.9584 | 270.2560 |
| ϕ (nm) | 262.4037 | 258.3605 | 256.7432 |
| d (nm) | 13.8107 | 13.5979 | 13.5128 |
| ω' | 0.5400 | 0.5350 | 0.5320 |
| a (nm) | 287.2800 | 284.6200 | 283.0240 |
| ϕ (nm) | 272.9160 | 270.3890 | 268.8728 |
| d (nm) | 14.3640 | 14.2310 | 14.1512 |

TABLE 7

Lattice constant a, diameter ϕ and wall thickness d for reflectors of Si, GaAs and InP at λ = 1060 nm.

| | Silicon ε = 11.4 | GaAs ε = 12.35 | InP ε = 12.6 |
|---|---|---|---|
| ω' | 0.4570 | 0.4400 | 0.4360 |
| a (nm) | 484.4200 | 466.4000 | 462.1600 |
| ϕ (nm) | 460.1990 | 443.0800 | 439.0520 |
| d (nm) | 24.2210 | 23.3200 | 23.108 |
| ω' | 0.4778 | 0.4638 | 0.4600 |
| a (nm) | 506.4680 | 491.6280 | 487.6000 |
| ϕ (nm) | 481.1446 | 466.0466 | 463.2200 |
| d (nm) | 25.3234 | 24.5814 | 24.380 |
| ω' | 0.4985 | 0.4875 | 0.4840 |
| a (nm) | 528.4100 | 516.7500 | 513.0400 |
| ϕ (nm) | 501.9895 | 490.9125 | 487.3880 |
| d (nm) | 26.4205 | 25.8375 | 25.652 |
| ω' | 0.5192 | 0.5112 | 0.5080 |
| a (nm) | 550.3520 | 541.8720 | 538.4800 |
| ϕ (nm) | 522.8344 | 514.7784 | 511.5560 |
| d (nm) | 27.5176 | 27.0936 | 26.924 |
| ω' | 0.5400 | 0.5350 | 0.5320 |
| a (nm) | 572.4000 | 567.1000 | 563.9200 |
| ϕ (nm) | 543.7800 | 538.7450 | 535.7240 |
| d (nm) | 28.6200 | 28.3550 | 28.196 |

TABLE 8

Lattice constant a, diameter ϕ and wall thickness d for reflectors of Si, GaAs and InP at λ = 10600 nm.

| | Silicon ε = 11.4 | GaAs ε = 12.35 | InP ε = 12.6 |
|---|---|---|---|
| ω' | 0.4570 | 0.4400 | 0.4360 |
| a (μm) | 4.8442 | 4.6640 | 4.6216 |
| ϕ (μm) | 4.6020 | 4.4308 | 4.3905 |
| d (μm) | 0.2422 | 0.2332 | 0.2311 |
| ω' | 0.4778 | 0.4638 | 0.4600 |
| a (μm) | 5.0647 | 4.9163 | 4.8760 |
| ϕ (μm) | 4.8114 | 4.6700 | 4.6322 |
| d (μm) | 0.2532 | 0.2458 | 0.2438 |
| ω' | 0.4985 | 0.4875 | 0.4840 |
| a (μm) | 5.2841 | 5.1675 | 5.1304 |

TABLE 8-continued

Lattice constant a, diameter ϕ and wall thickness d for reflectors of Si, GaAs and InP at λ = 10600 nm.

| | Silicon ε = 11.4 | GaAs ε = 12.35 | InP ε = 12.6 |
|---|---|---|---|
| ϕ (μm) | 5.0199 | 4.9091 | 4.8739 |
| d (μm) | 0.2642 | 0.2584 | 0.2565 |
| ω' | 0.5192 | 0.5112 | 0.5080 |
| a (μm) | 5.5035 | 5.4187 | 5.3848 |
| ϕ (μm) | 5.2288 | 5.1478 | 5.1156 |
| d (μm) | 0.2752 | 0.2710 | 0.2692 |
| ω' | 0.5400 | 0.5350 | 0.5320 |
| a (μm) | 5.7240 | 5.6710 | 5.6392 |
| ϕ (μm) | 5.4378 | 5.3874 | 5.3572 |
| d (μm) | 0.2862 | 0.2836 | 0.2820 |

The experimental validation of a two-dimensional crystal based on these results is described further with reference to the following Example.

EXAMPLE 4

In order to design an experimental crystal from a material having ε of about 12.0, the value of ω' at the center of the widest gap (ρ=0.475) was chosen, which is 0.4925. The frequency of the microwave source used in these experiments is 9.3 GHz, which is well within the calculated band gap. The resulting two-dimensional crystal design parameters are provided in Table 9.

TABLE 9

Design parameters for triangular lattice, ε = 12.0, ρ = 0.475

| Parameter | Value |
|---|---|
| Lattice constant, a | 15.9 mm |
| Hole diameter, ϕ | 15.1 mm |

Figure 5:
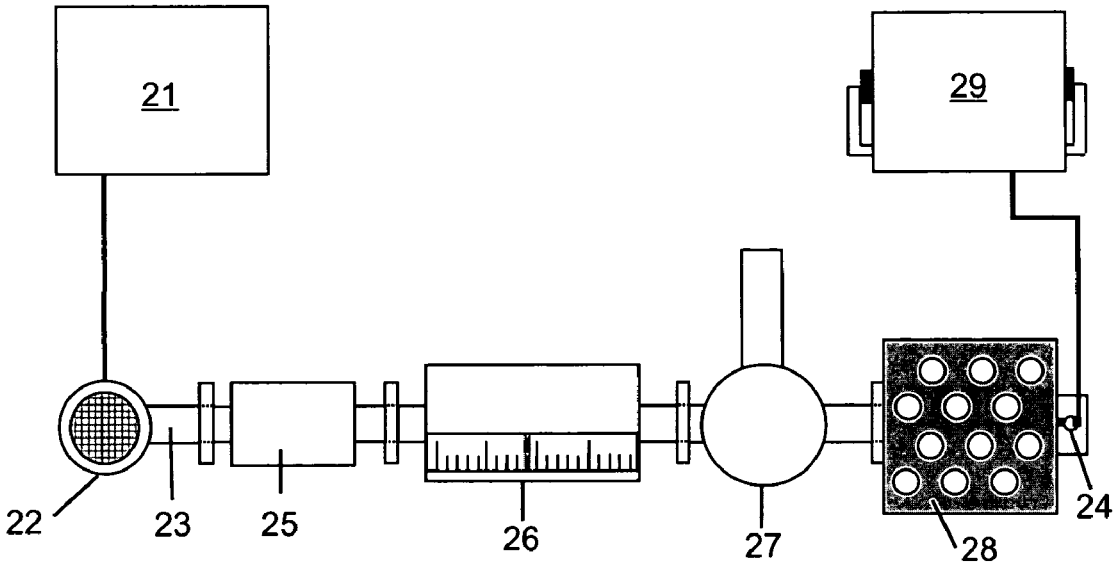
FIG. 5 provides a schematic layout of the experimental equipment used to test two-dimensional crystals.

A schematic layout of the experimental equipment is provided in FIG. 5. The power supply (21) supplies square wave modulated power to the microwave source (22) generating a square wave output at a frequency of 9.3 GHz. The source output is coupled to a waveguide (23) using coupling (25), which guides the waves through an attenuator (26) and a cavity (27) for intensity control. The device (28) being tested is placed against an open end of the waveguide (23). The adapter that attaches to the device (28) being tested is 2.3 cm wide, which is approximately the effective width of the source (22). The output is detected by a detector (24) and measured by an oscilloscope (29), which displays voltage amplitudes in mV. The oscilloscope amplitude is used as the measure of intensity in this study. The voltage amplitudes were measured after the microwave beam had passed through the photonic device (28). Although the precision of the equipment used was limited, the results obtained were accurate enough to provide an adequate measure of the efficiency of the devices tested.

The photonic material was placed in a metal casing to eliminate contamination by radiation leaking in the direction perpendicular to the plane of the device. During passage through the material, the incident radiation is partially absorbed by the material, partially transmitted through the material, some of it is back scattered and the remainder is trapped inside the device due to multiple scattering. To determine the efficiency of a device, it is necessary to isolate these losses individually. This requires an additional determination of the absorbed radiation, which was done by determining the intensity transmitted through a solid slab of the material used for fabricating the photonic device.

The absorption coefficient of the material was determined by measuring the transmitted intensity through a solid block of the synthetic material. The efficiency of a device is determined by observing the percentage of the incident intensity transmitted and absorbed. The remainder is the intensity back scattered at the junctions and trapped inside the device as a result of multiple reflections.

To determine the absorption coefficient of the dielectric material, a plain slab and a thin strip of the material were analyzed. In homogeneous material, the transmitted intensity $I_{trans}$ is given by:

$$I_{trans}=I_0e^{-\alpha A_d}$$

where $I_0$ is the incident intensity, a is the absorption coefficient, calculated below, and $A_d$ is the effective area of the dielectric material over which the microwave beam has been absorbed. Since the intensity is proportional to the oscilloscope amplitude measured in mV, values of intensity will be recorded in mV, for convenience.

The microwave source used was inhomogeneous; therefore intensity was not absorbed uniformly in all directions. It was observed that an insignificant (of the order of 1%) amount of intensity was measured from the sides of the blank slab, whereas a larger percentage (over 5%) was measured from the sides of the thin strip. Also, when the blank slab was oriented along its width, intensity was concentrated within about 7 cm either side of the center. It was concluded from these observations that the beam was mainly concentrated within a narrow angle of dispersion, and measurements were made accordingly.

Figure 6:
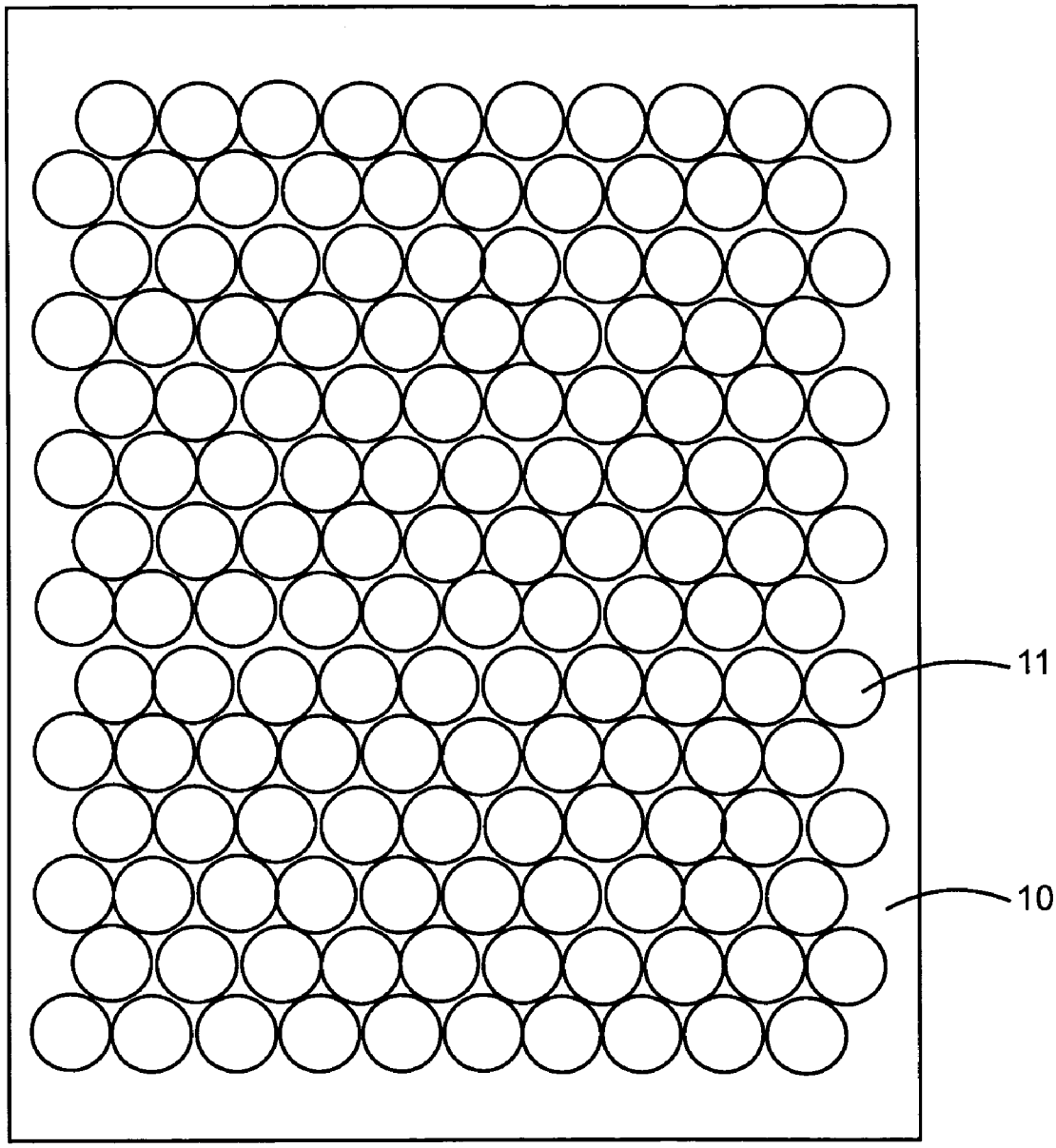
FIG. 6 is a plan view of an embodiment of a two-dimensional photonic reflector.
Figure 7:
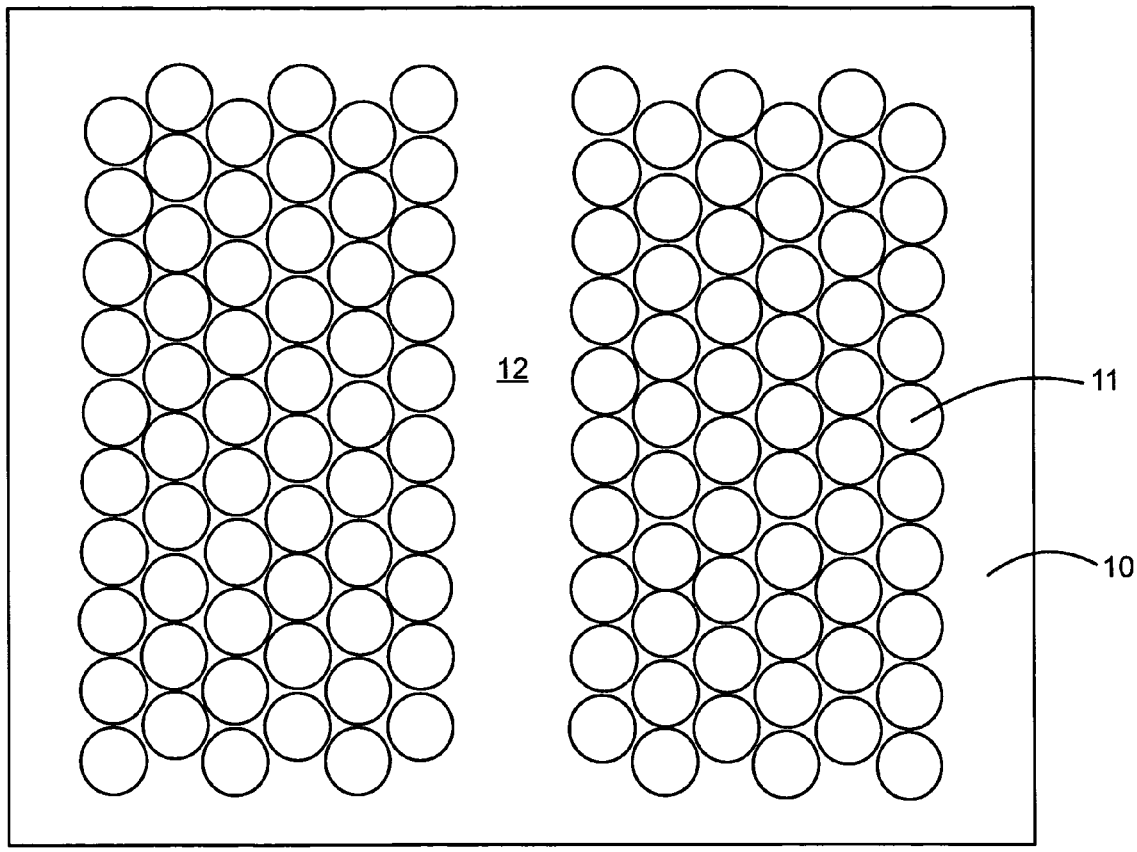
FIG. 7 is a plan view of an embodiment of a straight photonic waveguide.
Figure 8:
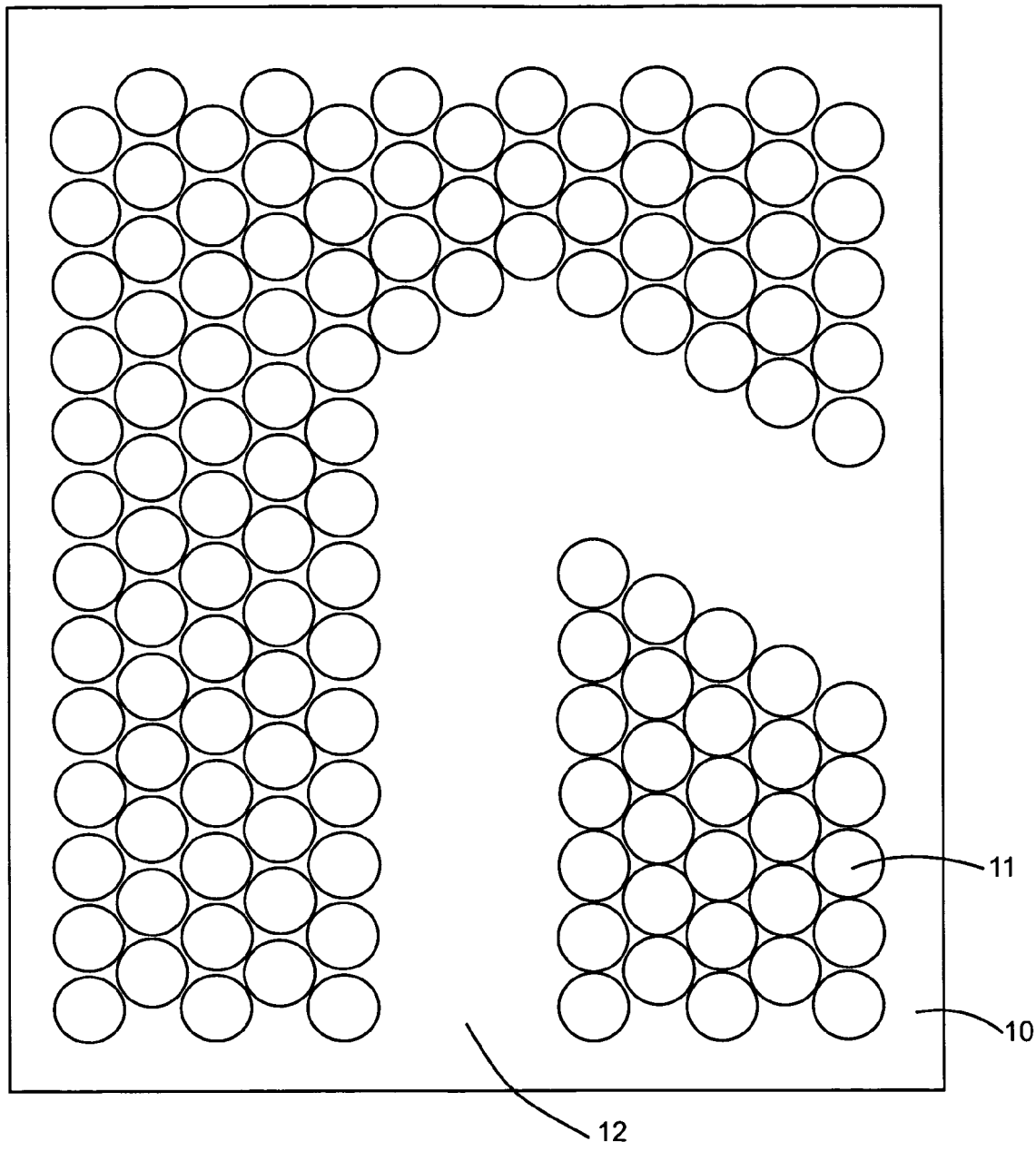
FIG. 8 is a plan view of an embodiment of a bent photonic waveguide.
Figure 9:
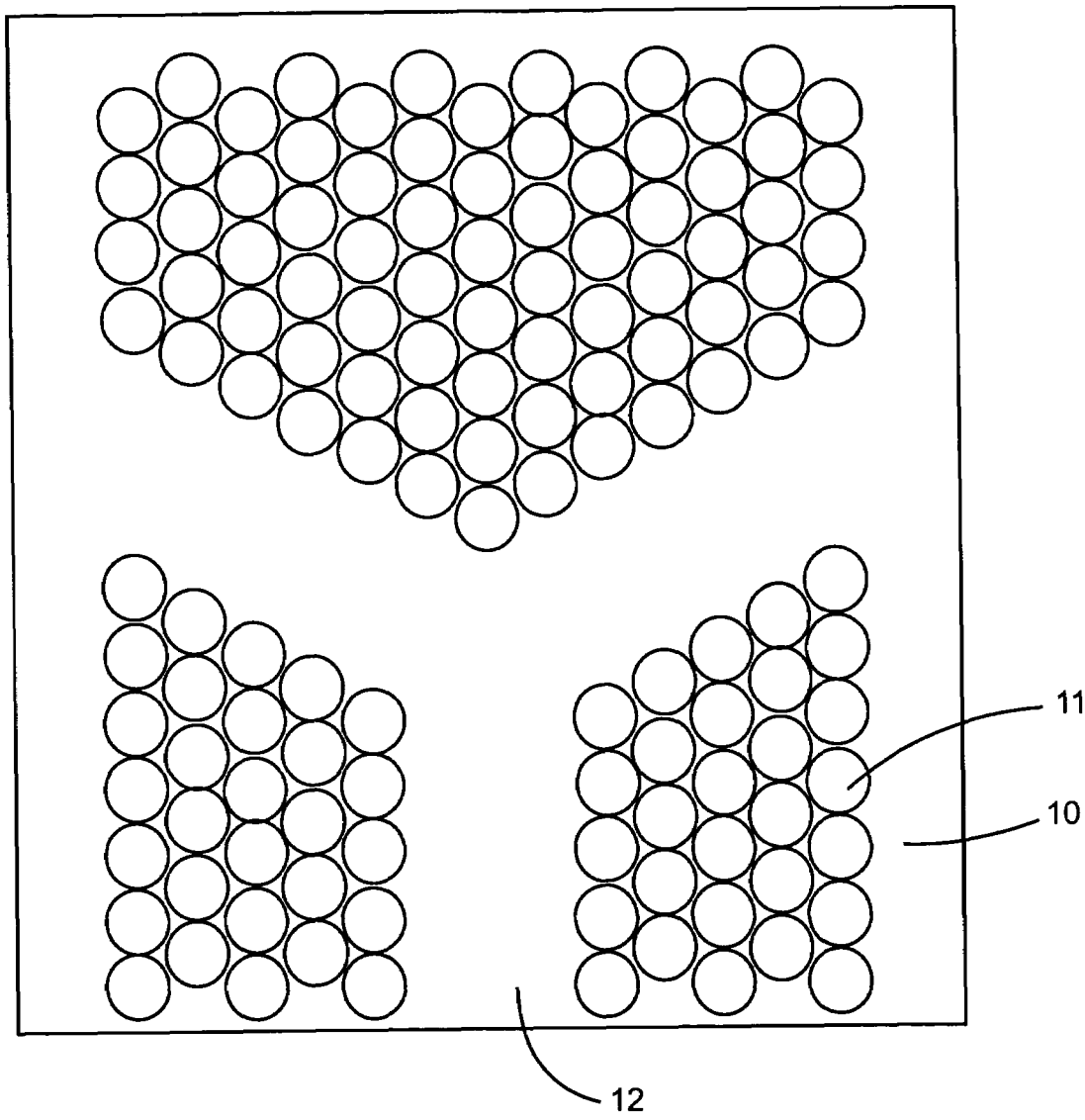
FIG. 9 is a plan view of an embodiment of a Y-shaped splitter.
Figure 10:
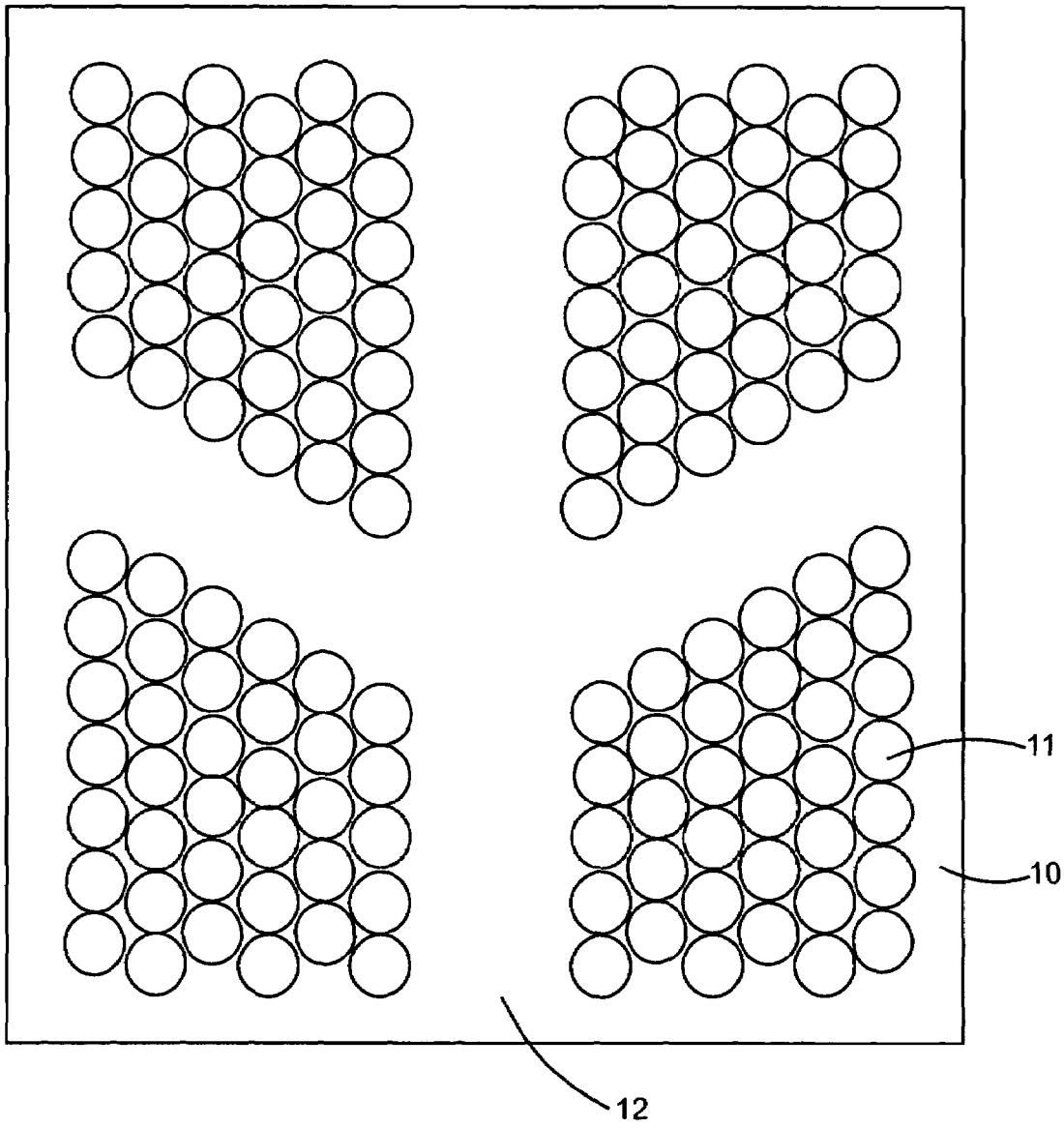
FIG. 10 is a plan view of an embodiment of a pitchfork-shaped splitter.

Analysis of the experimental results using the above equation and an incident intensity of 500 mV yielded a value of 0.00509 $cm^{-2}$ for the absorption coefficient. Following testing of the plain slab and thin strip, the devices tested were the reflector, straight wave-guide, bent wave-guide, Y-splitter and the pitchfork splitter. These devices are depicted in FIGS. 6, 7, 8, 9 and 10, respectively. Each device comprises a block of a dielectric material (10) having a plurality of holes (11) machined therefrom of a size and spacing consistent with a and ρ. Referring to FIG. 6, the block (10) has a width of 177.8 mm and a length of 219.0 mm. The center to center spacing between holes (11) in a given row was 15.9 mm along the width of the block (10). The vertical distance between centers in adjacent rows was 13.7 mm. Referring to FIGS. 7-9, the size and spacing of the holes (11) was identical to FIG. 6, as were the dimensions of the block (10). The holes (11) along either side of the guide path (12) are provided with a center to center spacing of 41.1 mm. The centers of the first row of holes (11) were provided about 20.45 mm from the width of the block (10) and the last hole (11) in each row was positioned with its center 13.175 mm from the length of the block (10). Referring to FIG. 10, the width of the block (10) was 241.3 mm and all other dimensions remained the same as in the previous figures.

The bent, Y-shaped and pitchfork shaped devices were tested in both the forward and backward directions (i.e. from the starting point on the width to the at least one ending point and vice versa). The efficiencies for these devices, calculated for the forward direction using the experimental results obtained through repeat testing and the absorption coefficient determined above, are provided in Table 10.

TABLE 10

Efficiency for several devices at 9.3 GHz

| Device | Efficiency |
|---|---|
| Reflector | 98% |
| Straight Wave Guide | 88% |
| Bent Wave Guide | 44% |
| Y-Splitter | 72% |
| Pitchfork Splitter | 83% |

A preferred reflector is at least 90% efficient and the reflector tested was found to be at least 98% efficient. A preferred waveguide is at least 80 to 85% efficient and the straight waveguide tested was found to be about 88% efficient. Thus, about 12% of the intensity was trapped as a result of multiple reflections inside the wave-guide and absorption within the crystal. A preferred waveguide is at least 40-45% efficient and the bent wave-guide was found to be about 44% efficient on average in the forward direction with a 120° bend, with about 56% of the incident intensity trapped or back scattered at the bend. A preferred Y-splitter is at least 70-75% efficient and the Y-splitter tested was about 72% efficient in the forward direction. A preferred pitchfork splitter is at least 80-85% efficient and the pitchfork splitter tested was found to be about 83% efficient for the forward split. The loss occurred in trapped intensity and scattering at the junctions.

Figure 11:
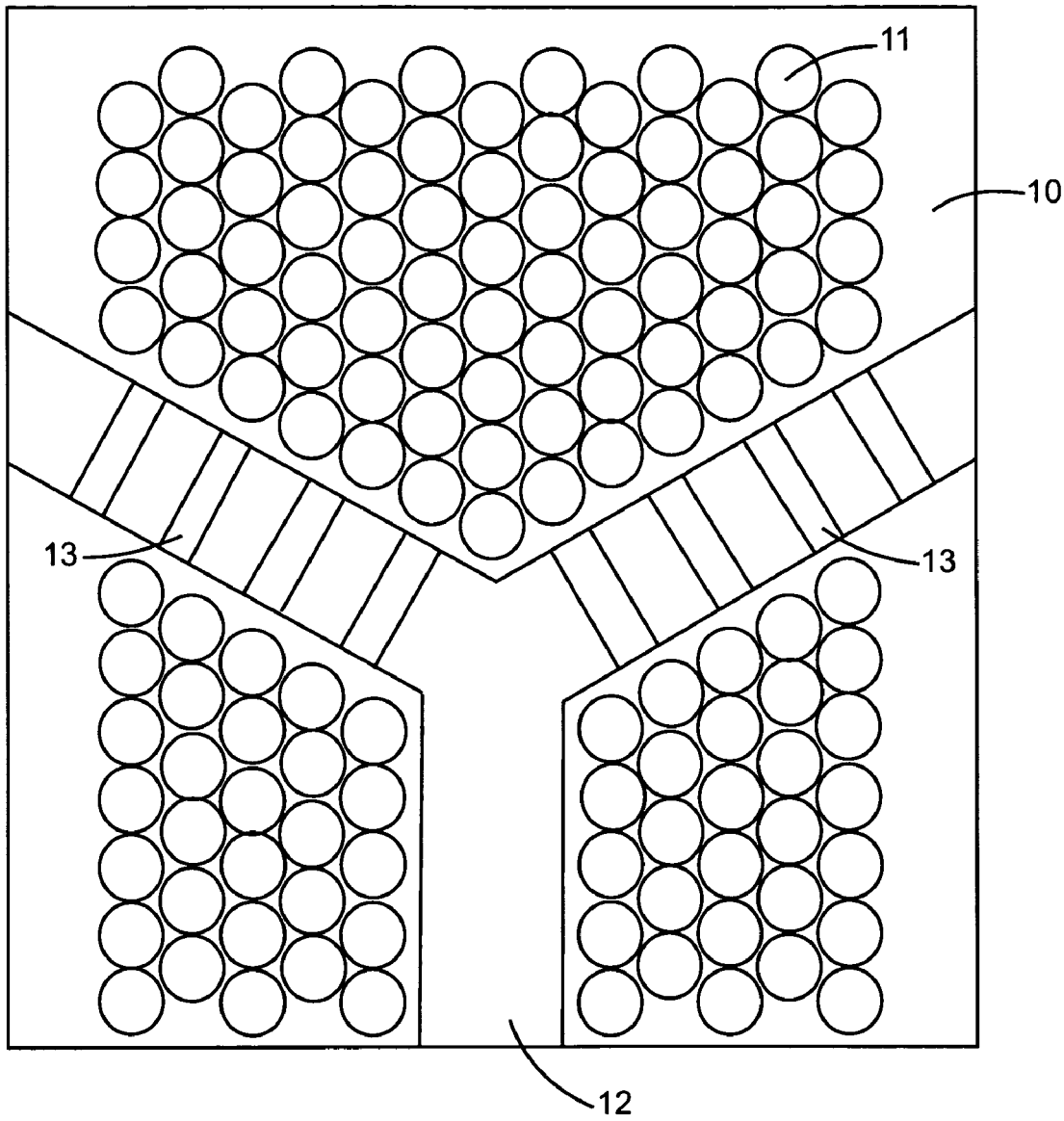
FIG. 11 is a schematic illustration of a Y-splitter comprising a combined one-dimensional and two-dimensional PBG crystal.

FIG. 11 provides a schematic illustration of a combined one-dimensional and two-dimensional PBG crystal in the form of a Y-splitter. Each branch of the Y-splitter includes a plurality of slots (13) machined in precise dimensions to create a one-dimensional crystal within each branch of the Y-splitter. The bandgap of each one-dimensional crystal permits only specified frequencies to pass and reflects the others, thereby creating a spectral separation on the incident electromagnetic radiation along each branch of the two-dimensional splitter.

Other advantages which are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

The invention claimed is:

1. A waveguide comprising a photonic bandgap crystal for use in directing or splitting incident photonic radiation, the waveguide comprising:

a) a block of a first material having a first dielectric constant, the block having a length, a width and a thickness;

b) a guide path for directing or splitting photonic radiation through the crystal, the guide path having a starting point on the width and at least one ending point on the length or width;

c) a plurality of cylindrical holes, each having a longitudinal axis parallel to the thickness and a radius perpendicular thereto, the holes provided along the length and width of the block outside the guide path and arranged in a triangular lattice having a lattice constant, the holes containing a second material having a second dielectric constant less than the first dielectric constant;

d) wherein the first dielectric constant is from 7.4 to 25, the second dielectric constant is from 0.9 to 1.1 and the ratio of the radius to the lattice constant is from 0.45 to 0.495.

2. The waveguide of claim 1, wherein the waveguide has an efficiency of at least 70%.

3. The waveguide of claim 1, wherein the first dielectric constant is about 12, the second dielectric constant is about 1 and the ratio of the radius to the lattice constant is 0.475.

4. The waveguide of claim 3, wherein the guide path is straight, bent, Y-shaped or pitchfork shaped, the frequency of the photonic radiation is from 9 to 13 GHz and wherein the waveguide has an efficiency of at least 44%.

5. The waveguide of claim 3, wherein the guide path is straight, the frequency of the photonic radiation is 9.3 GHz and wherein the waveguide has an efficiency of at least 85%.

6. The waveguide according to claim 1, wherein the photonic bandgap crystal has a periodic crystal structure and the guide path is bounded by an arrangement of a plurality of reflectors preserving the periodicity of the crystal structure.

7. The waveguide according to claim 2, wherein the photonic bandgap crystal has a periodic crystal structure and the guide path is bounded by an arrangement of a plurality of reflectors preserving the periodicity of the crystal structure.

8. The waveguide according to claim 3, wherein the photonic bandgap crystal has a periodic crystal structure and the guide path is bounded by an arrangement of a plurality of reflectors preserving the periodicity of the crystal structure.

9. The waveguide according to claim 4, wherein the photonic bandgap crystal has a periodic crystal structure and the guide path is bounded by an arrangement of a plurality of reflectors preserving the periodicity of the crystal structure.

10. The waveguide according to claim 5, wherein the photonic bandgap crystal has a periodic crystal structure and the guide path is bounded by an arrangement of a plurality of reflectors preserving the periodicity of the crystal structure.

11. The waveguide according to claim 1, further comprising at least one one-dimensional photonic bandgap crystal in the guide path.

12. The waveguide according to claim 4, further comprising at least one one-dimensional photonic bandgap crystal in the guide path.

13. The waveguide according to claim 6, further comprising at least one one-dimensional photonic bandgap crystal in the guide path.

14. The waveguide according to claim 9, further comprising at least one one-dimensional photonic bandgap crystal in the guide path.

* * * * *